US009127885B2

(12) United States Patent
Provenzano et al.

(10) Patent No.: US 9,127,885 B2
(45) Date of Patent: Sep. 8, 2015

(54) PORTABLE CLOTHING DRYER

(71) Applicant: MD2G, LLC, Wilmington, DE (US)

(72) Inventors: Antonino Provenzano, Dix Hills, NY (US); Robert Freidenrich, New York, NY (US)

( * ) Notice: Subject to any disclaimer, the term of this patent is extended or adjusted under 35 U.S.C. 154(b) by 135 days.

(21) Appl. No.: 13/734,420

(22) Filed: Jan. 4, 2013

(65) Prior Publication Data

US 2014/0190033 A1 Jul. 10, 2014

(51) Int. Cl.

| | |
|---|---|
| ***F26B 25/08*** | (2006.01) |
| ***F26B 9/00*** | (2006.01) |
| ***F26B 9/06*** | (2006.01) |

(52) U.S. Cl.

CPC ..... *F26B 25/08* (2013.01); *F26B 9/003* (2013.01); *F26B 9/066* (2013.01)

(58) Field of Classification Search

CPC ..... F26B 19/00; F26B 21/00; F26B 25/00; F26B 25/08; A47L 15/00; A47B 43/00

USPC ..... 34/202, 239, 622; 4/541.2, 679; D32/6; 223/66, 67, 37, 68, 70

See application file for complete search history.

(56) References Cited

U.S. PATENT DOCUMENTS

| | | | | | |
|---|---|---|---|---|---|
| 245,361 | A | * | 8/1881 | Evestaff | 223/67 |
| 1,570,508 | A | * | 1/1926 | Lungstras | 223/67 |
| 2,338,776 | A | * | 1/1944 | Miller | 223/67 |
| 2,701,921 | A | * | 2/1955 | Strongson | 34/622 |
| 3,160,482 | A | * | 12/1964 | Foote | 34/665 |
| 3,165,244 | A | * | 1/1965 | Dosal | 223/67 |
| 3,576,079 | A | * | 4/1971 | Hauser | 34/542 |
| 3,610,251 | A | * | 10/1971 | Sanderson | 607/107 |
| 3,739,492 | A | * | 6/1973 | Brooks | 34/622 |
| 3,858,331 | A | * | 1/1975 | Lord | 34/621 |
| 3,905,125 | A | * | 9/1975 | Hubner | 34/622 |
| 4,406,071 | A | * | 9/1983 | Buchanan | 34/91 |
| 4,572,364 | A | * | 2/1986 | Jordan | 206/287 |
| 4,578,881 | A | * | 4/1986 | Karlsson | 34/619 |
| 4,592,497 | A | * | 6/1986 | Georges | 223/69 |
| 4,868,998 | A | * | 9/1989 | Rubin | 34/91 |

(Continued)

FOREIGN PATENT DOCUMENTS

| | | | |
|---|---|---|---|
| DE | 3514828 | * | 1/1987 |
| WO | WO 89/00622 | * | 1/1989 |
| WO | WO 00/24959 | * | 4/2000 |

*Primary Examiner* — Stephen M Gravini

(74) *Attorney, Agent, or Firm* — Abelman, Frayne & Schwab

(57) ABSTRACT

A portable garment dryer, operable with a portable electric hair dryer which includes an outlet nozzle that can produce a heated airflow, the portable garment dryer including:

a. a housing formed by sidewalls, an open top end and a closed bottom end, the housing being telescopically collapsible in a top to bottom direction from an extended state to a contracted state, the housing side wall having an aperture extending transversely therethrough and into which the outlet nozzle of a portable electric hair dryer is insertable for directing a heated airflow into and through the housing and out the top end thereof, and b. a perforated garment support mountable in the housing, the garment support adapted to support at least one garment in the heated airflow when the outlet nozzle of a portable hair dryer is inserted into the aperture in said housing wall, whereby the garment can be dried by the heated airflow from the portable hair dryer.

20 Claims, 14 Drawing Sheets

(56) References Cited

U.S. PATENT DOCUMENTS

| | | | | | |
|---|---|---|---|---|---|
| D314,070 | S | * | 1/1991 | Rubin | D28/54.1 |
| 5,095,559 | A | * | 3/1992 | Liljegren et al. | 4/541.2 |
| 5,361,516 | A | * | 11/1994 | Dahman | 34/440 |
| 5,394,621 | A | * | 3/1995 | Levy | 34/103 |
| 5,555,648 | A | * | 9/1996 | Griffin | 34/621 |
| 5,642,572 | A | * | 7/1997 | Manning | 34/621 |
| 5,675,907 | A | * | 10/1997 | Reppas et al. | 34/202 |
| 5,992,039 | A | * | 11/1999 | Bunch et al. | 34/91 |
| 6,041,517 | A | * | 3/2000 | Wang | 34/439 |
| 6,047,482 | A | * | 4/2000 | Roper | 34/106 |
| D468,873 | S | * | 1/2003 | Varma | D32/6 |
| RE38,591 | E | * | 9/2004 | Kellogg et al. | 34/442 |
| 7,367,137 | B2 | * | 5/2008 | Jonsson et al. | 34/265 |
| 7,770,305 | B1 | * | 8/2010 | Krauss | 34/60 |
| 7,941,936 | B2 | * | 5/2011 | Mangano | 34/235 |
| 8,667,707 | B2 | * | 3/2014 | Date et al. | 34/565 |
| 8,813,385 | B2 | * | 8/2014 | Blum | 34/97 |
| 2006/0137211 | A1 | * | 6/2006 | Casella et al. | 34/231 |
| 2009/0184141 | A1 | * | 7/2009 | Marino et al. | 223/69 |
| 2014/0190033 | A1 | * | 7/2014 | Provenzano et al. | 34/202 |

* cited by examiner

PORTABLE CLOTHING DRYER

I. FIELD OF THE INVENTION

This invention is in the field of portable clothing dryers, and particularly portable clothing dryers that utilize a conventional portable electric hair blower/dryer to provide heated airflow.

II. BACKGROUND AND PRIOR ART

This invention addresses the common problem for travelers who may need to wash and dry small garments, particularly undergarments and even hair pieces, in a hotel room that does not have basic washer/dryer laundry facilities.

Obviously, a traveler could hang such hand washed articles on a cord strung in a bathroom or other area; however, natural drying time may be inconveniently long, and if the environment is humid the article may not dry at all.

Numerous arrangements have been developed to utilize a common electric hair dryer, also called hair blower or dryer/blower, as a hot airflow source in attempts to dry wet garments in an area without a conventional electric tumble dryer. In one such arrangement there is a chamber which may be a garment bag into which a heated airflow is directed. A sampling of prior art arrangements is described below, each with its own functional features and limitations.

U.S. Pat. No. 6,757,586 to Miller et al. discloses a telescopically collapsible housing of square cross-section which is collapsible to a relatively thin box. This device does not use a portable hair dryer, and instead has its own heater, motor, fan and rotatable drum, and is quite large, heavy and expensive.

U.S. Pat. No. 3,164,755 to Moore discloses a large vinyl bag with a suspension hook at the top, a slide zipper to receive a garment, and an opening at the bottom to receive a hairdryer outlet that directs a hot airflow via a restriction nozzle into the expansion space within the bag.

U.S. Published Application No. 2008/0184590 to Lozaro discloses a large portable collapsible clothes dryer for use with a blower. This device has a shell housing encompassing a collapsible wire frame, and in open state includes struts to support clothes hangers.

U.S. Pat. No. 5,996,249 to Manning discloses an elongated bag that is suspended with a hair dryer blowing in at the top with a top collar structure to support clothes on a hanger. This bag is collapsible to a flat state.

U.S. Pat. No. 5,014,446 to Reesman discloses non-collapsible box housing with an inlet hole for a hair dryer nozzle.

U.S. Pat. No. 5,443,538 to Little discloses a non-collapsible drum-shaped box with a hair dryer.

III. SUMMARY AND OBJECTS OF THE NEW INVENTION

A first object of the present invention is to provide a portable garment dryer which may utilize a conventional electric hair dryer and which is collapsible into a relatively small space for travel and for storage, and is expandable to its functional drying mode configuration.

Another object is to provide a portable garment dryer which is collapsible but in its extended dryer configuration is strong enough to suspend one or more garments in a generally spread-out state in the path of the heated airflow.

A further object is to provide a portable garment dryer that is operative with a large variety of different conventional portable electric hair dryers which have airflow outlet nozzles of different outside diameters and lengths.

A still further object is to provide a portable garment dryer utilizing a conventional electric hair blower/dryer that directs the heated airflow into and through a garment suspended within the drying chamber.

An additional object is to provide a drying area of greater diameter than the diameter of the outlet nozzle of the electric hair dryer, and to provide a suitable airflow downstream of the nozzle into said garment that is suspended in the airflow.

Another object is to provide a portable garment dryer structure that telescopically extendible between a compressed shallow height state and its extended or open state.

A further object is to provide apparatus as described above comprising a cylindrical housing formed of flexible round cylindrical segments molded as a contiguous structure.

A still further object is to provide a portable garment dryer as described above where said housing is a bi-stable structure and where the cylindrical segments, when slightly pushed, snap to their telescopically extended state or to their telescopically collapsed state in accordion style.

A yet additional object is to provide a portable dryer for drying hair pieces.

The present invention overcomes numerous disadvantages of prior art portable garment dryer's, particularly those requiring their own heaters. As seen here, the present apparatus can be used with a great variety of conventional portable electric hair blower/dryers because of its variable size air inlet hole on the side of the housing.

In any dryer it is desirable for the garment to be spread out in a reasonably thin layer so that the airflow can quickly interact with and dry the garment fabric. The present invention provides a structure to spread a garment out for this heating and drying phase, while allowing the housing to collapse into a relatively much smaller space for storage and traveled. Also the device is extremely simple and more efficient to operate when compared to prior art devices. For example, trying to dry a garment while it is in the garment bag requires the device the bag and the garment to be hung and to attempt to distribute the garment into a thin layer to receive airflow over a large part of the garment surface. Other prior art devices are rigid and thus not collapsible and awkward and difficult for packing and travel. Still other prior art devices require a particular portable electric hair dryer, whereas the present device will operate with any one of a great many different commercial portable hair blower/dryers having different sizes of exhaust nozzles.

In summary the present invention is portable clothing dryer for small articles such as a woman's undergarments. The new apparatus which utilizes a hairdryer as the source of heat and flowing hot air, is a flexible collapsible chamber or housing, which in the preferred embodiment, extends into a circular cylinder, or collapses accordion style to a fraction of its extended operational height. In one preferred embodiment the cylindrical housing when expanded to its full height of about six inches and diameter of nine inches, and has a variable-sized aperture in the sidewall which allows the nozzle of a common hairdryer to be inserted for directing hot air into the central space within the cylinder. The top of the cylindrical housing has an open top area to which may be attached a perforated garment support element and a lid or rim to retain the garment. Clothing such as panties or bra or other articles such as hairpieces are parked atop the support which is situated to be spaced above the floor of the chamber. The hot air can flow through the support from the sides and the bottom, flow upward through the wet article, and exhausts through the top of the housing. The new device can also be used to dry hair pieces safely and quickly.

This invention provides a solution for travelers who need a small lightweight collapsible garment dryer that can dry small garments, utilizing a common portable hair dryer that the traveler is likely to already have in her luggage or have available in a hotel or motel room. This new device can quickly dry various articles where there is no other practical solution, and can do so using any one of a large variety of common hairdryers or blower dryers.

The first embodiment disclosed herein is adapted to dry small garments positioned inside the housing; the second embodiment disclosed is adapted to dry larger garments that cannot fit inside the housing; the third embodiment is adapted to dry hair pieces.

The basic concept is a drying chamber with an opening to receive the nozzle from a common hairdryer, while the chamber is collapsible into a relatively flat or thin state for travel storage purposes. Since this new device is a flexible but self-supporting structure, no additional frame, internal or external structure is needed. The materials of the housing and of the garment support are heat resistant, such as silicone rubber. The housing's sidewall opening to receive the nozzle in the preferred embodiment has four slits to create flaps that can deflect to accommodate nozzles of many different sizes and shapes. It is not necessary that the nozzle fit tightly in the opening, because some small leakage will not materially interfere with the operation of the apparatus.

It has been found that small articles of clothing can be dried very quickly in this apparatus because the heated airflow is confined to the small space within the cylinder and concentrated on the article, as opposed to typical prior art garment dryers where articles are hung in large bags and heated air is widely dissipated. When collapsed, this product occupies little space and thus is highly suitable for travelers who have limited space in luggage and in hotel rooms.

In the preferred embodiments of the present invention, a single molded tube comprises three cylindrical segments stacked lengthwise, with a flexible cylindrical junction ring between adjacent ends of each two adjacent cylindrical segments. For clarity and convenience, these three cylindrical segments will be designated as bottom, middle and top cylindrical segments. Each junction ring functions as a coupling for a bi-stable connection, meaning the segments will resiliently tend to go to and remain in either: (a) the telescopically extended mode where the segments are positioned end-to-end into their overall elongated tubular state, or (b) telescopically compressed mode where the middle ring segment is situated radially inward of the bottom ring segment, and the top ring segment is situated radially inward of the middle ring segment, while all three ring segments remain concentric about the single central axis.

The resilient bi-stable nature of this housing is achieved by the junction ring zone having a thinner wall thickness than the adjacent bottom and middle ring segments, for example. Each of the bottom and middle ring segments tend to remain in the circular shape or tend to return to said circular shape when deformed radially inwardly and axially as when it is pushed toward a telescopically extended or telescopically compressed configuration relative to the adjacent circular segment. Thus, each junction area extends generally lengthwise in its axially extended mode, and has a U-shape cross-section when the adjacent segments are telescopically compressed. The same is true of the junction ring axially between the middle and top segments.

Also in the preferred embodiments, the terminal top and bottom ends of the top and bottom ring segments respectively, are thickened radially and/or folded over forming a flange to add strength and stability, so that the housing drying chamber can stand vertically and support the garment or article that is extended transversely of the upward airflow.

IV. BRIEF DESCRIPTION OF THE DRAWINGS

FIG. 1 is front perspective exploded view of our new portable garment dryer in its telescopically extended state, FIG. 1A is a front elevation view of the apparatus of FIG. 1 shown in its telescopically collapsed state, FIG. 2 is a front elevation of the dryer of FIG. 1, FIG. 3 is a cross-sectional view taken along line 3-3 of FIG. 2, showing a garment support rack installed in the dryer housing, FIG. 3A is a cross-sectional view similar to FIG. 3, with an article of clothing supported on the rack atop the housing, FIG. 3B is a fragmentary cross-sectional view generally similar to FIG. 3A, but showing a garment billowing upward from the top of the housing.

FIG. 4 is a cross-sectional and top plan view taken along line 4-4 in FIG. 3 showing the rack installed in the dryer housing, FIG. 5 is a sectional view taken along line 5-5 in FIG. 4, showing structure of said rack, FIG. 6 is an exploded top front perspective view similar to FIG. 1 showing a second embodiment of the portable garment dryer, FIG. 7 is a cross-sectional view similar to FIG. 3 showing a small garment supported on an internal rack and a blower/dryer nozzle inserted into an opening in the wall of the lower segment of the housing, FIG. 8A is a fragmentary cross-section elevation view similar to FIG. 3A, but showing the structure of the housing sidewall with the lower two cylindrical segments in partially collapsed state, FIG. 8B is a fragmentary cross-section elevation similar to FIG. 8A showing the two lower cylindrical segments in further collapsed state, FIG. 8C is a cross-section elevation continuing the sequence of FIGS. 8A and 8C, now showing the housing in fully collapsed state.

V. DETAILED DESCRIPTION OF THE PREFERRED EMBODIMENTS

For convenience and clarity in describing the new apparatus, similar elements or components appearing in different will have the same reference.

A. Structure of the Embodiments

Figure 1:
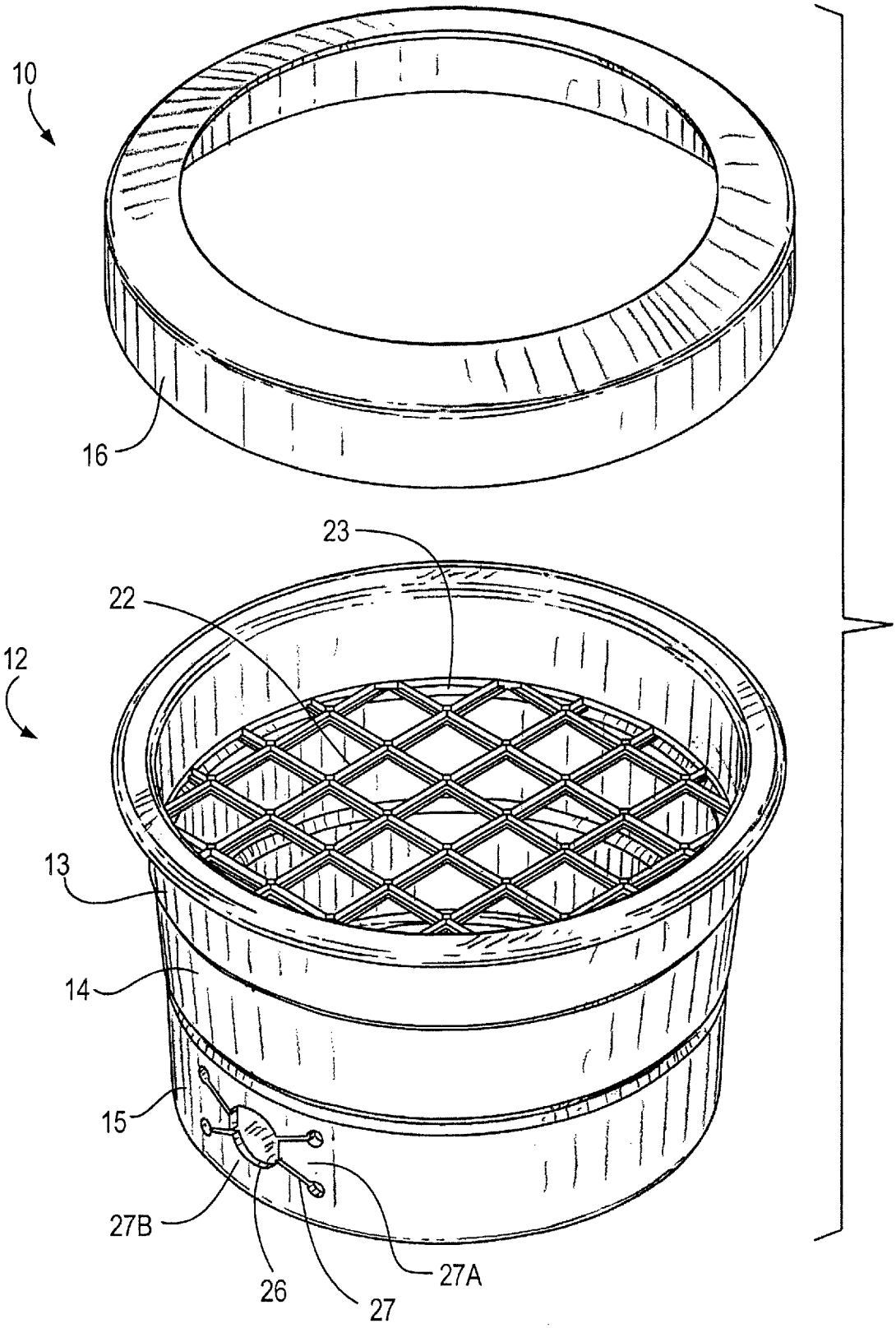
Figure 1A:
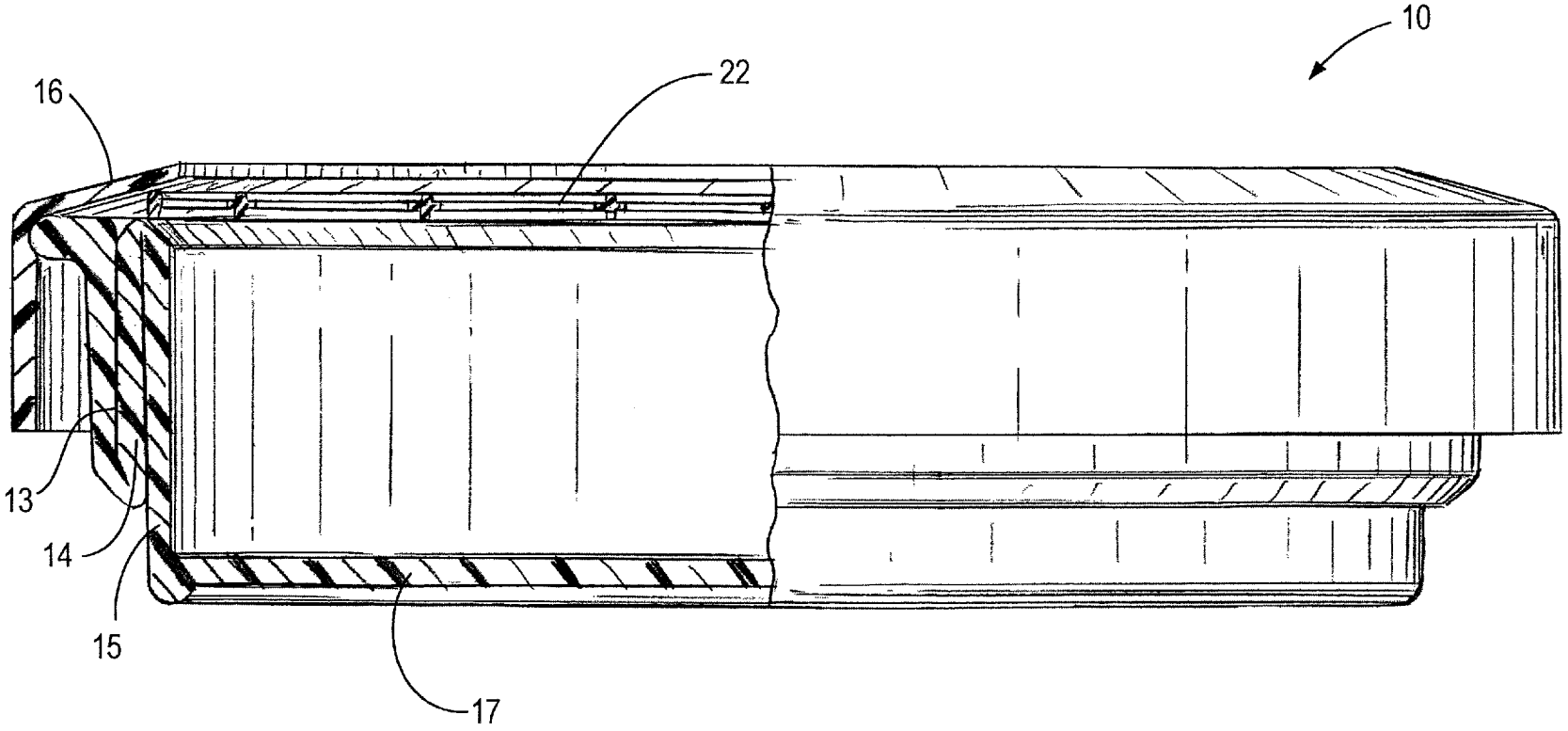
Figure 2:
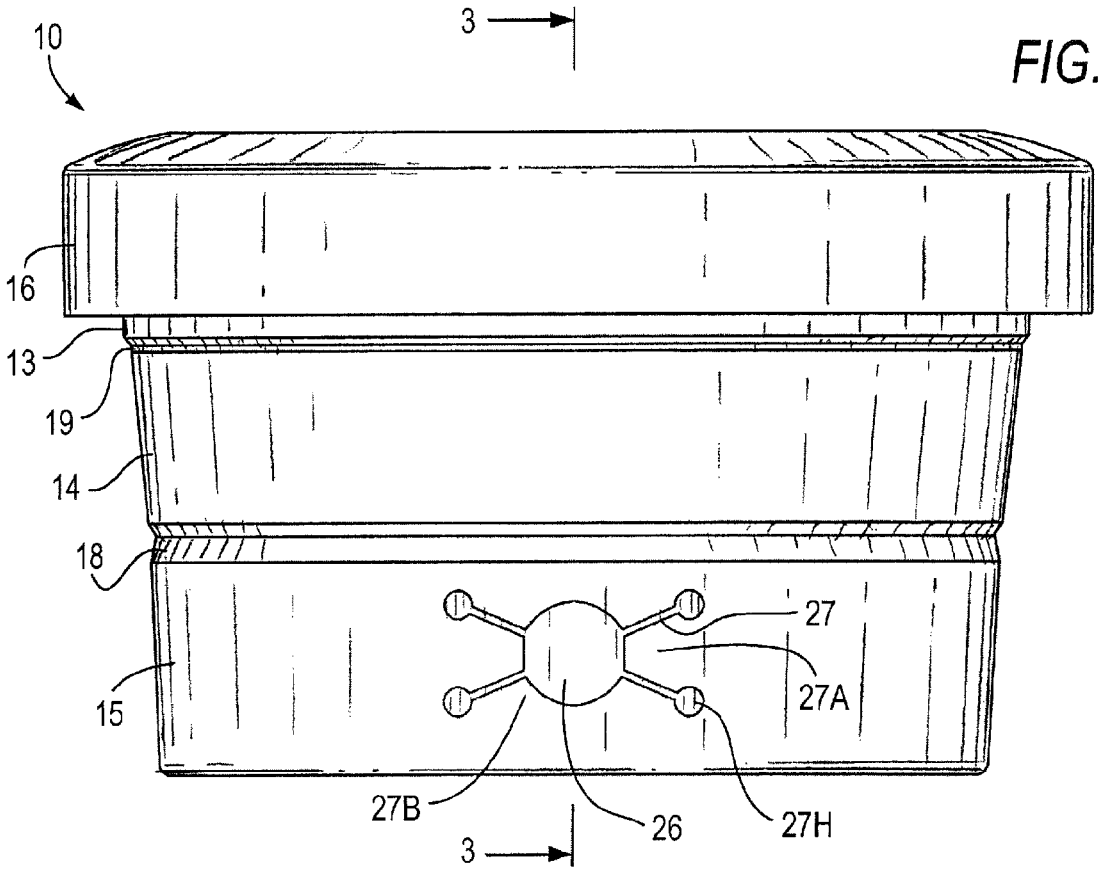
Figure 3:
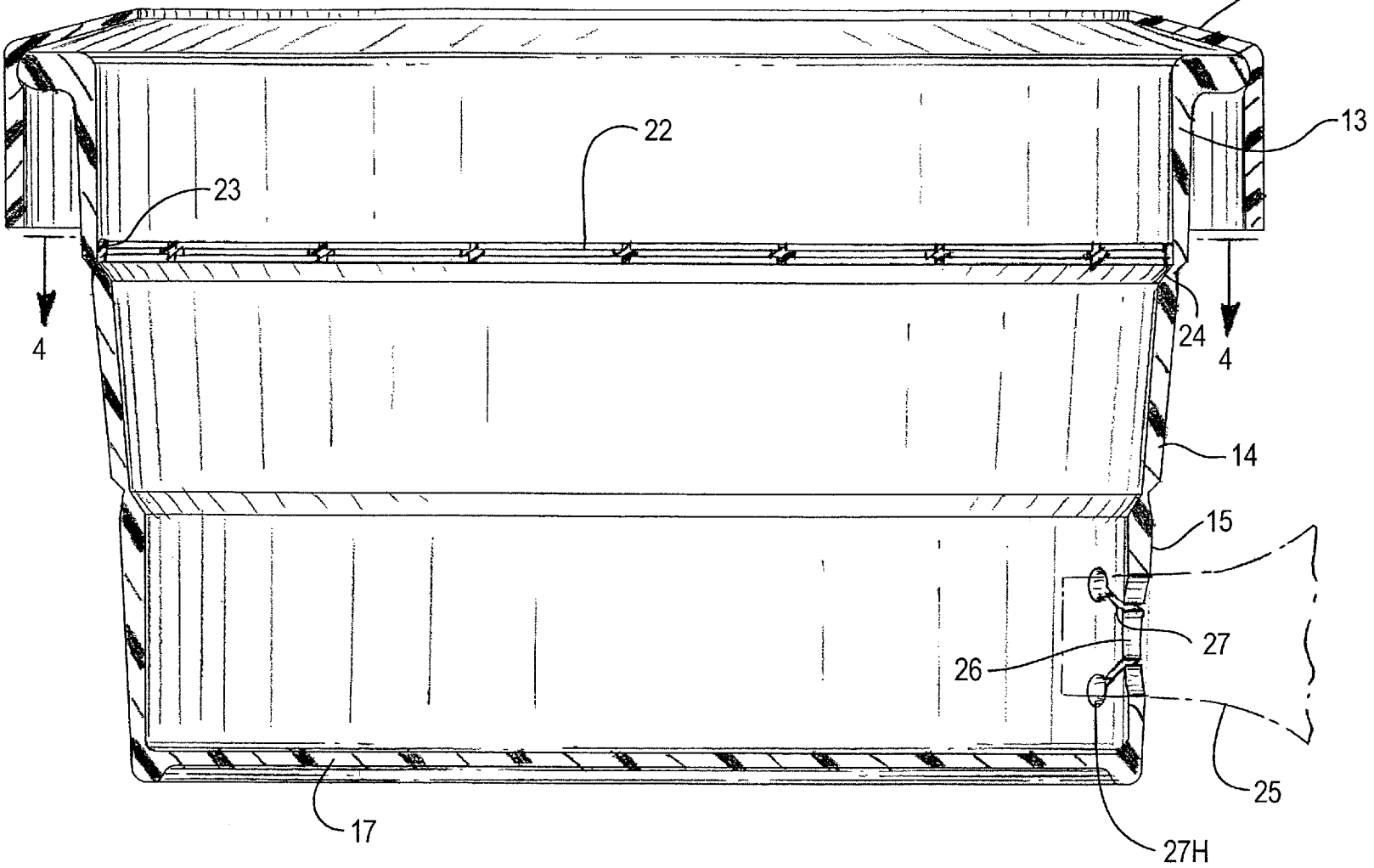

A first embodiment of the present invention is a portable collapsible garment dryer 10 shown in its fully collapsed state in FIG. 1A, and shown in its fully telescopically extended state in FIGS. 1-3. This garment dryer is constructed as a flexible cylindrical housing 12 formed of three cylindrical segments, namely top segment 13, middle segment 14 and bottom segment 15, top ring 16 and floor 17. The adjacent middle and bottom segments 14, 15 are connected by a foldable joint 18, top and middle segments 13, 14 are connected by a similar foldable joint 19, and bottom segment 15 is connected to a floor 16 panel by bendable joint 20.

Figure 8A:
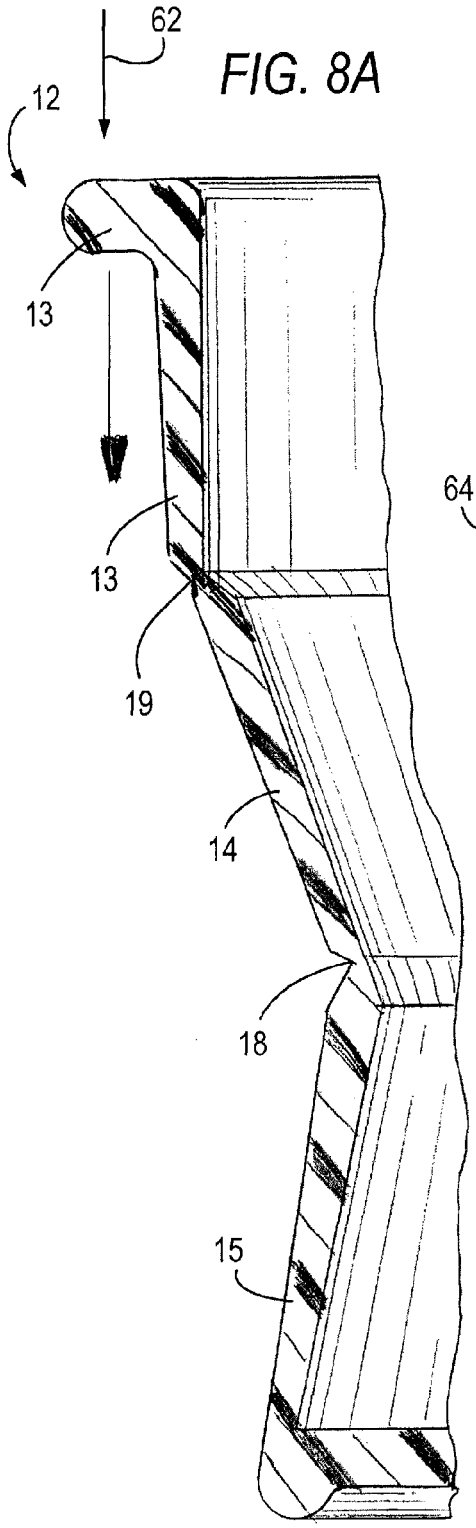
Figure 8B:
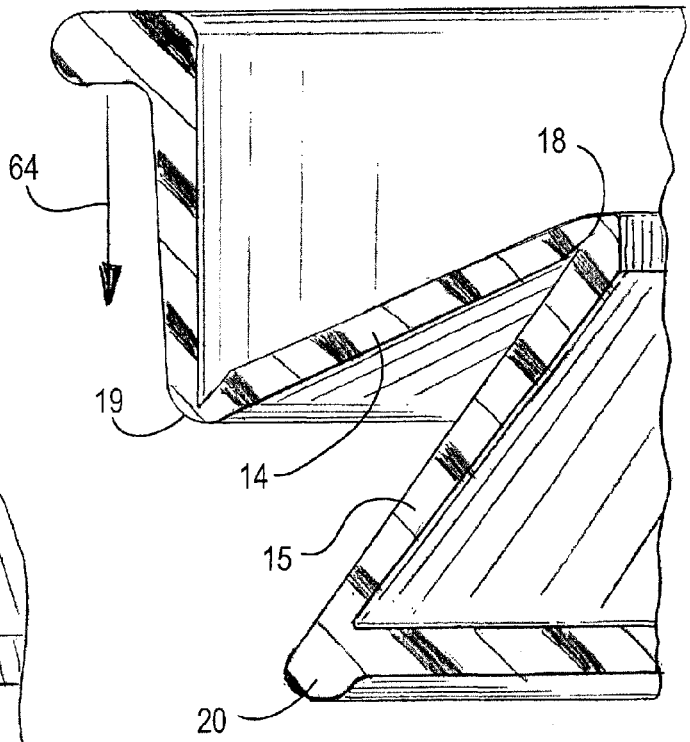
Figure 8C:
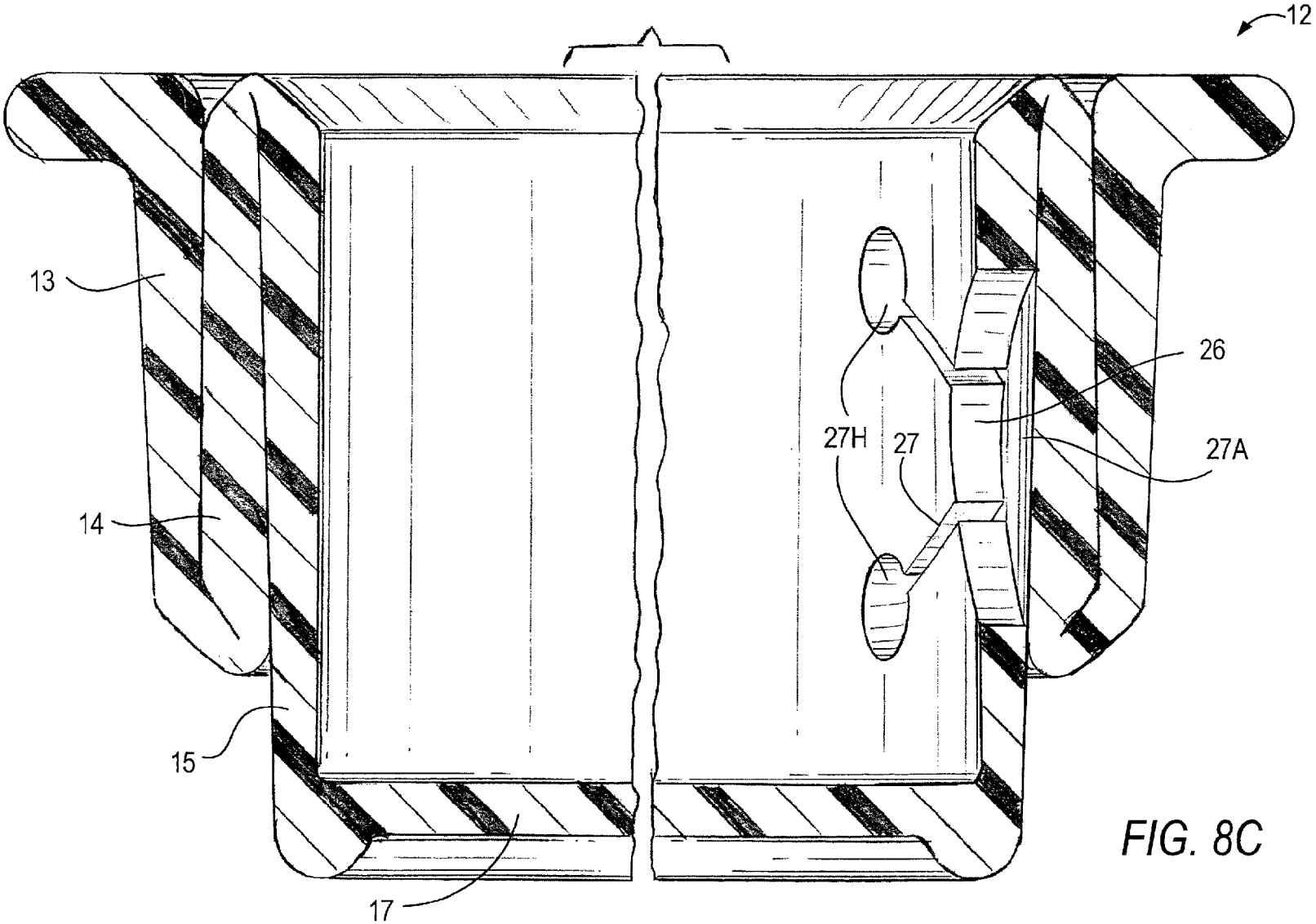

FIG. 8A shows the beginning of partial telescopic collapse of housing 12 by inward bending of joint 18 between middle and lower segments 14, 15. FIG. 8B shows further bending of joints 18, 19 and 20 between said upper, middle and lower segments 13, 14, and 15 and floor 16. Finally, FIG. 8C shows housing 12 fully telescopically collapsed to its minimum height for subsequent storage or travel by a user.

Figure 5:
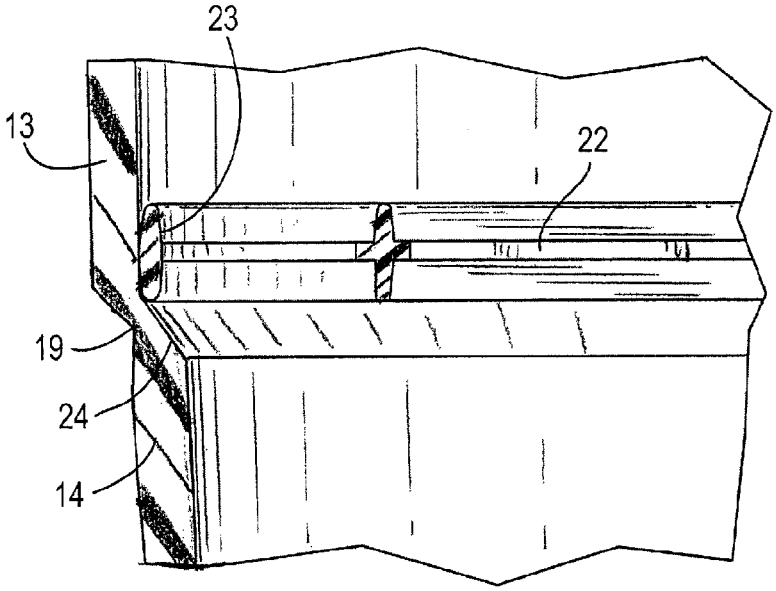
Figure 6:
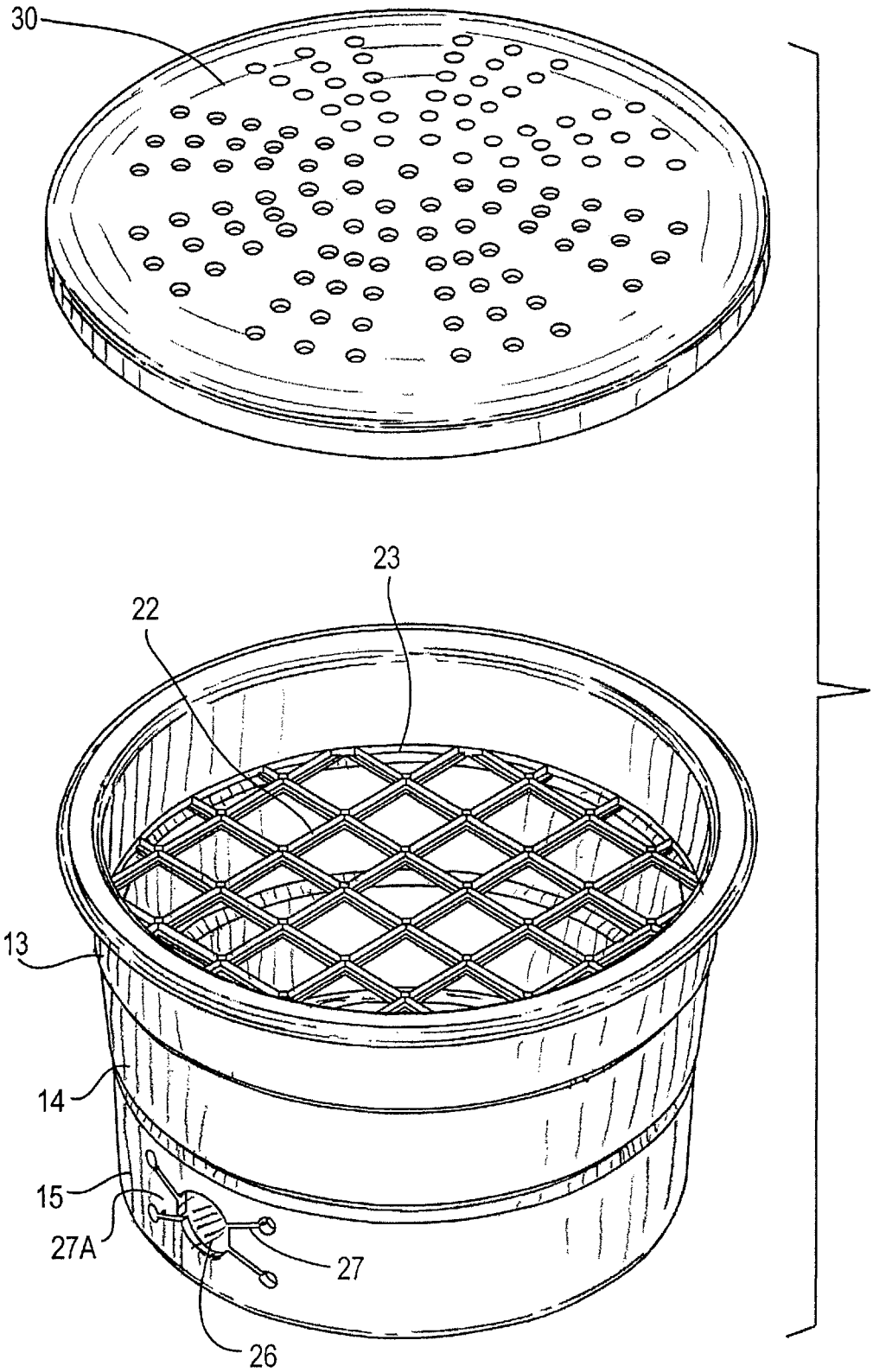
Figure 7:
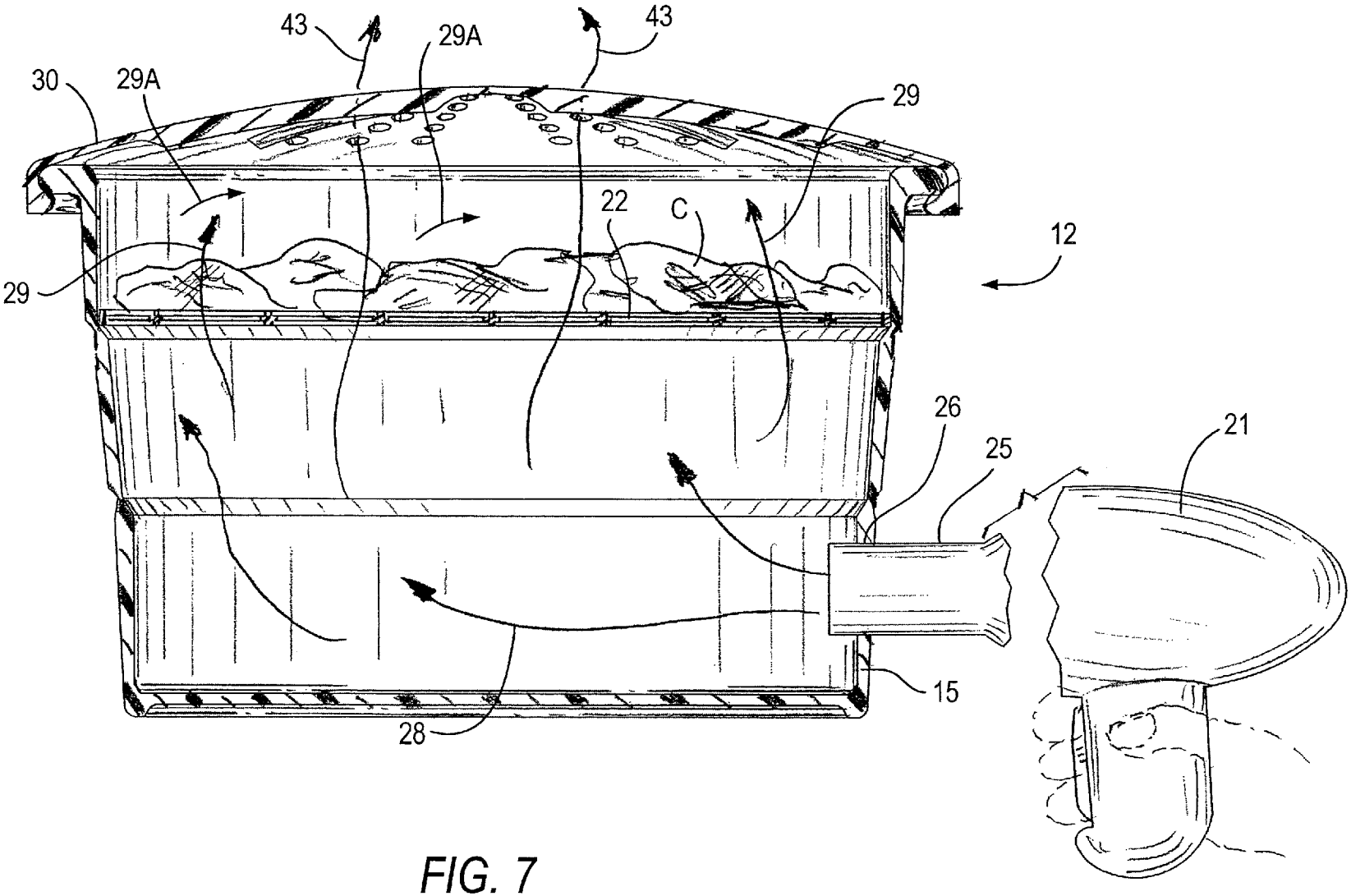

In this first embodiment of our new invention FIGS. 1-3 illustrate a housing 12 employing support rack 22 situated as shown with its outer peripheral edge 23 engaging and supported by shoulder 24 of joint 18 of the cylindrical housing 12, see FIGS. 1, 3 and 5. As shown in FIG. 7 one or more small articles of clothing C are spread out upon the top of rack 22. Heated air is provided by a small portable electric hair blower/dryer 30 of which there are many commercially available products. The outlet nozzle 25 of the hair blower/dryer 24 is inserted in aperture 26 in the sidewall of lower segment 15 of housing 12. Heated airflow in housing 12 is shown by arrows 28 below rack 22 and by arrows 29 above rack 22. If a perforated lid 30 is employed above the rack as seen in FIGS. 6 and 7 then airflow above the rack is partially restrained from a direct exhaust outflow, and instead this airflow becomes turbulent and churns above and through garments C on the rack as indicated by arrows 29A, such that drying of these garments is hastened. The hole pattern in the perforated lid may greatly vary, this embodiment showing a pattern of approximately 120 holes of approximately ¼ inch diameter spaced apart from each other on a disk shaped lid of approximately 10 inch diameter.

Figure 3A:
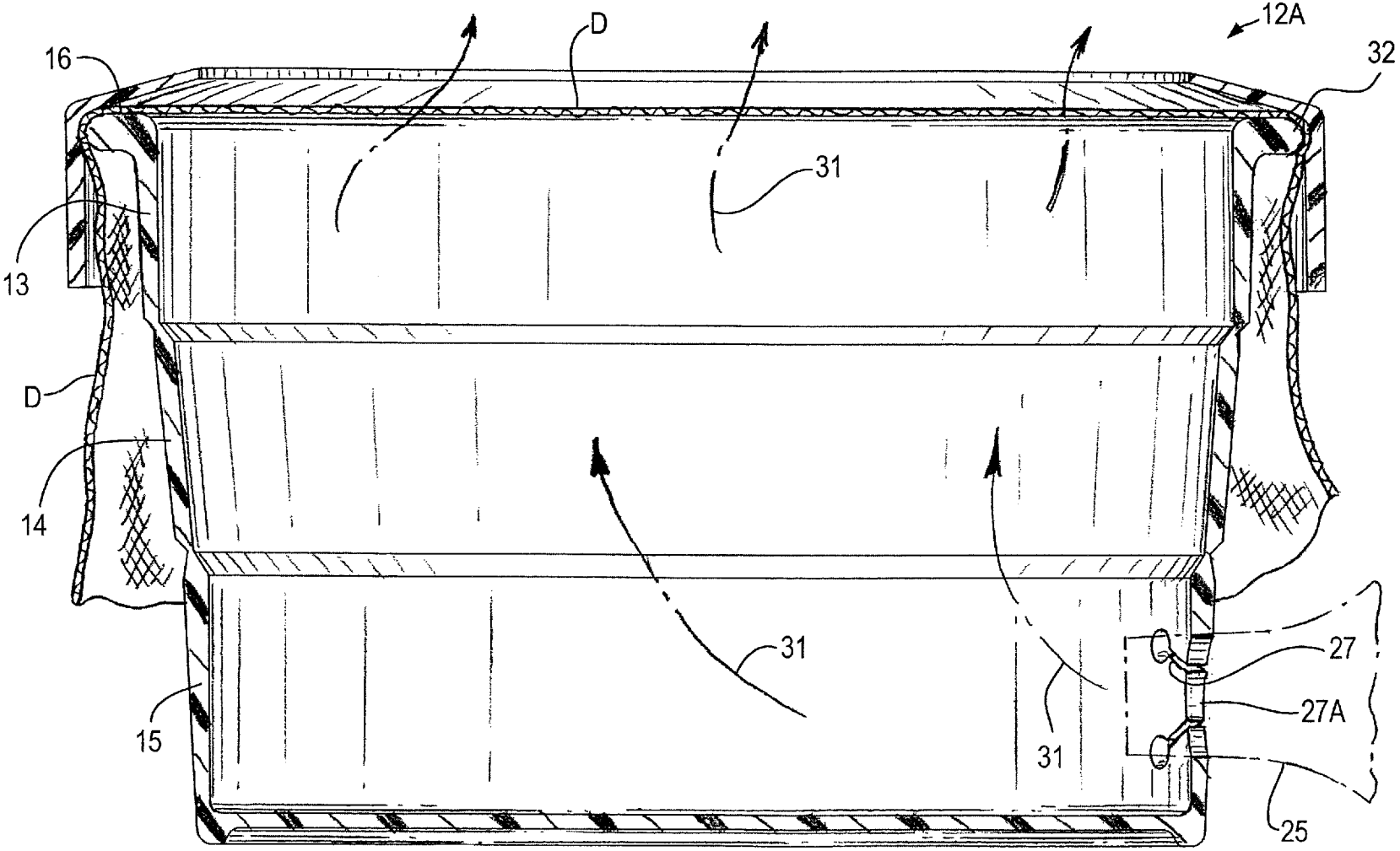

In a second embodiment 12A of this apparatus as shown in FIG. 3A garments D too large for the rack in the first embodiment, are positioned atop the top opening of housing and from time to time are moved laterally until different portions of these garments are positioned to receive the heated airflow indicated by arrows 31. This is in contrast to small garments such as bras, panties and socks which can fit better upon rack 22 situated in the housing as shown in FIGS. 1-3.

As seen in FIG. 3A, a garment D can be releasably secured or stabilized in that position by a rim or ring 16 installed atop rack. The rim's peripheral edge may engage elastically about the housing top edge 32, or may be coupled thereto by other means.

Figure 3B:
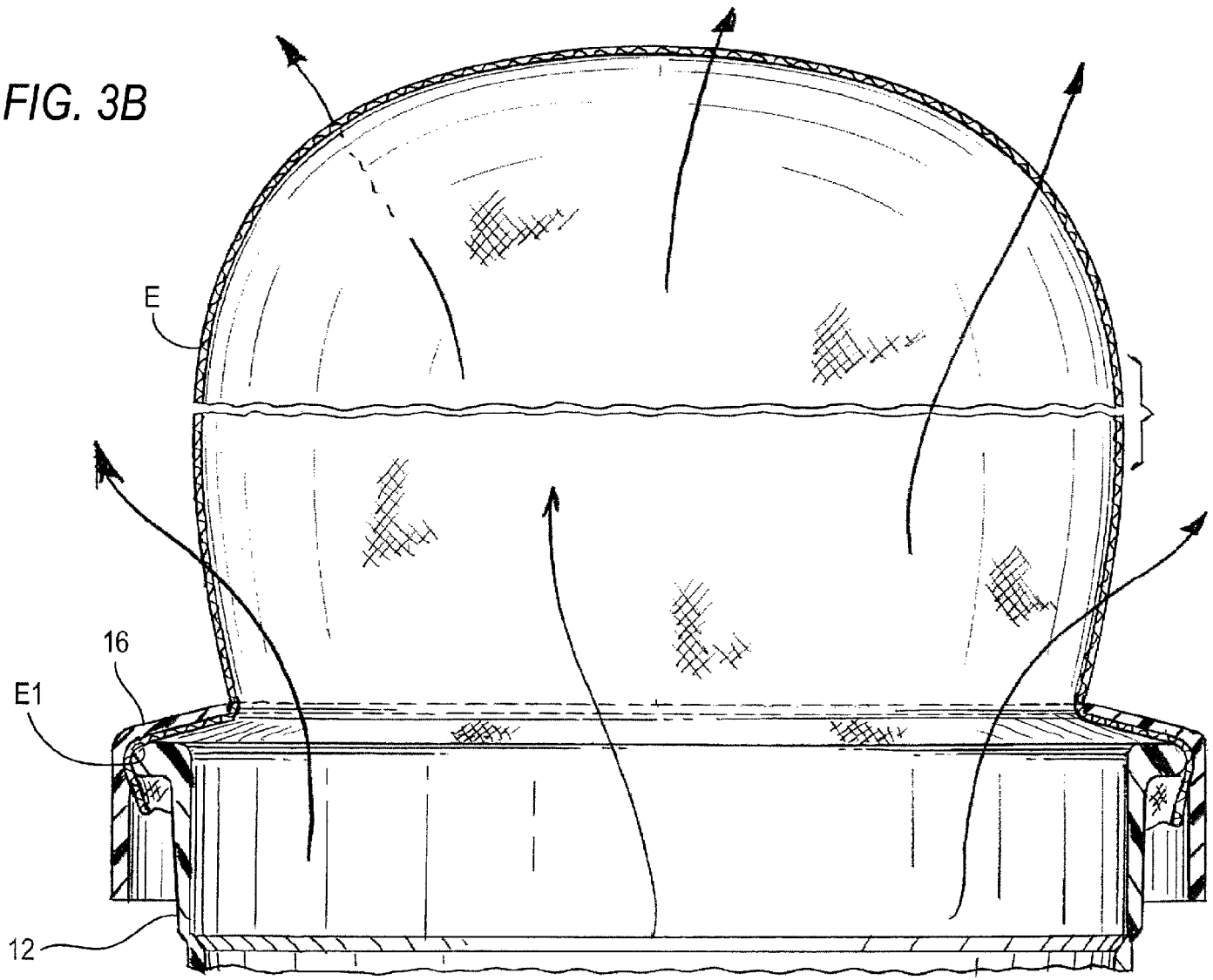
Figure 4:
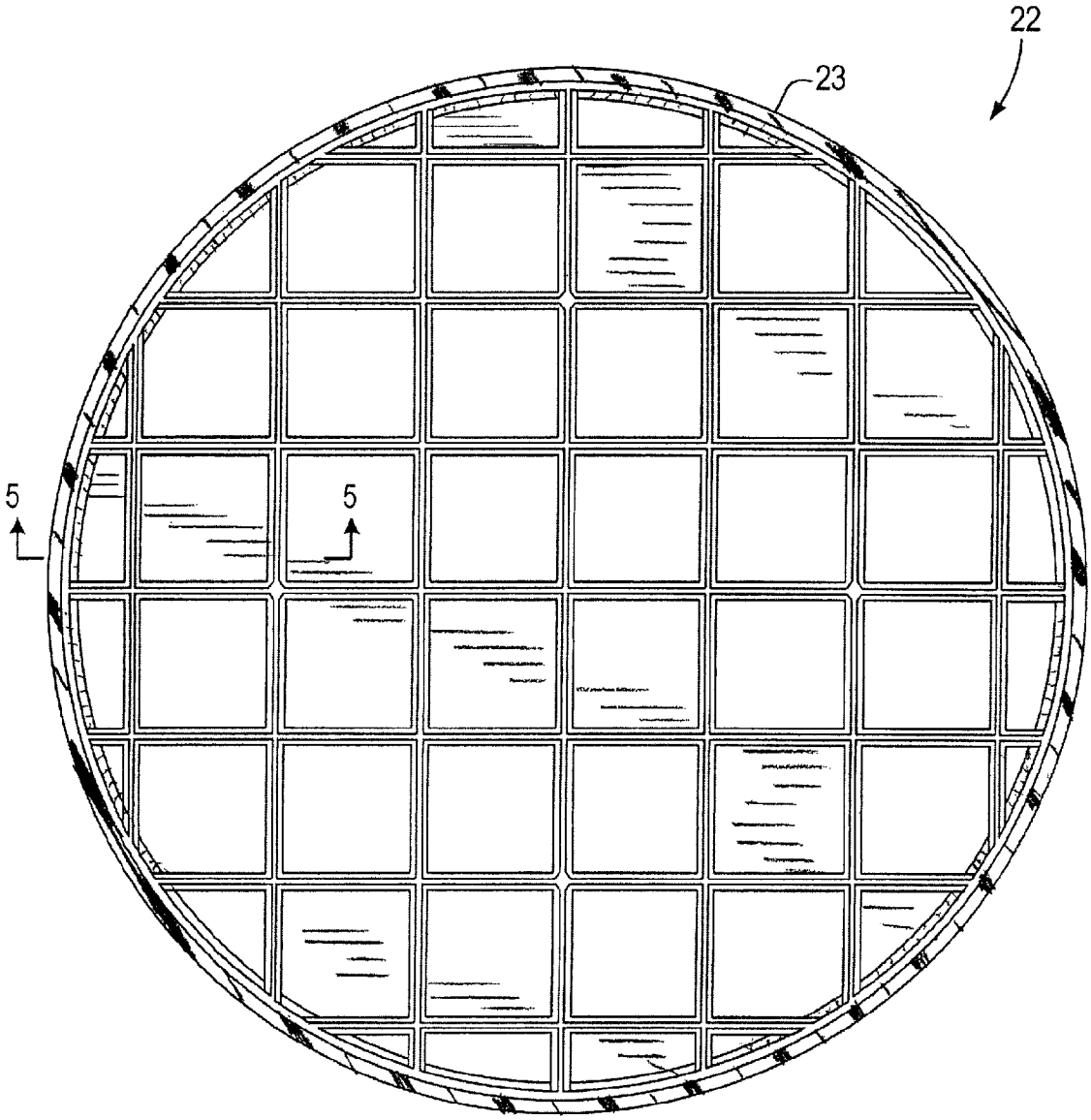

A further variation is the embodiment disclosed in FIG. 3B showing a garment E (a) that has area larger than the area of the top opening of housing 12, and (b) that has its generally peripheral edges E1 engaged by housing rim 16*m* leaving the main body of garment E to billow upward from the force of heated airflow indicated by arrows 31. With this arrangement a larger portion of the garment can be dried with a single stage of positioning.

Figure 11:
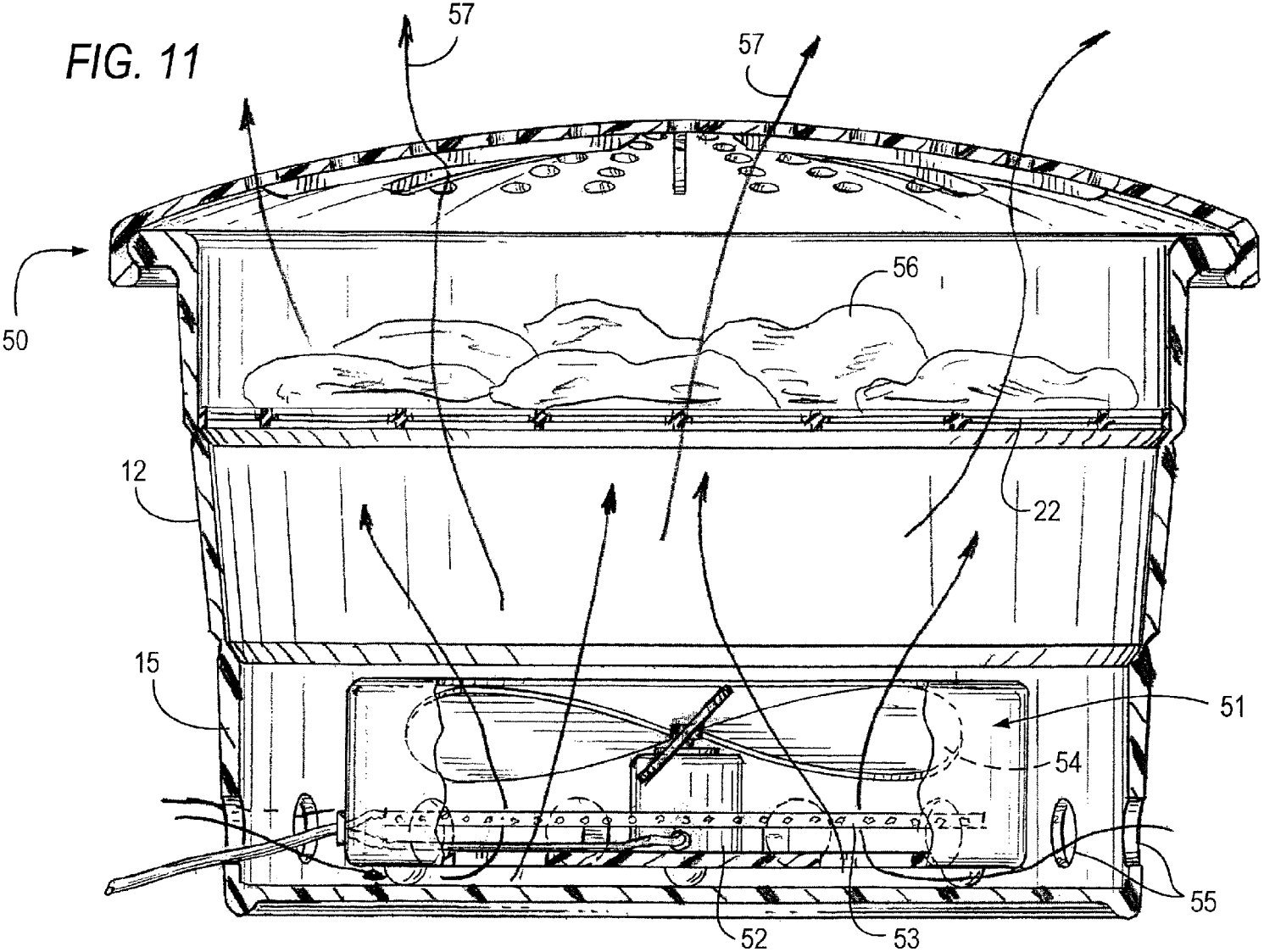
FIG. 11 is an elevation view in section of a further embodiment which includes an internal heater and fan.

A fourth embodiment 50 illustrated in FIG. 11 employs a garment dryer housing 12 generally similar to that of FIG. 1, but includes its own heart/blower 51 shown schematically as motor 52, heater 53 and fan blades 54. The housing 12 has circumferentially spaced air inlet apertures 55 distributed around the lower housing segment 15. Small garments 56 are supported on rack 22, and heated airflow is indicated y arrows 57.

Figure 9:
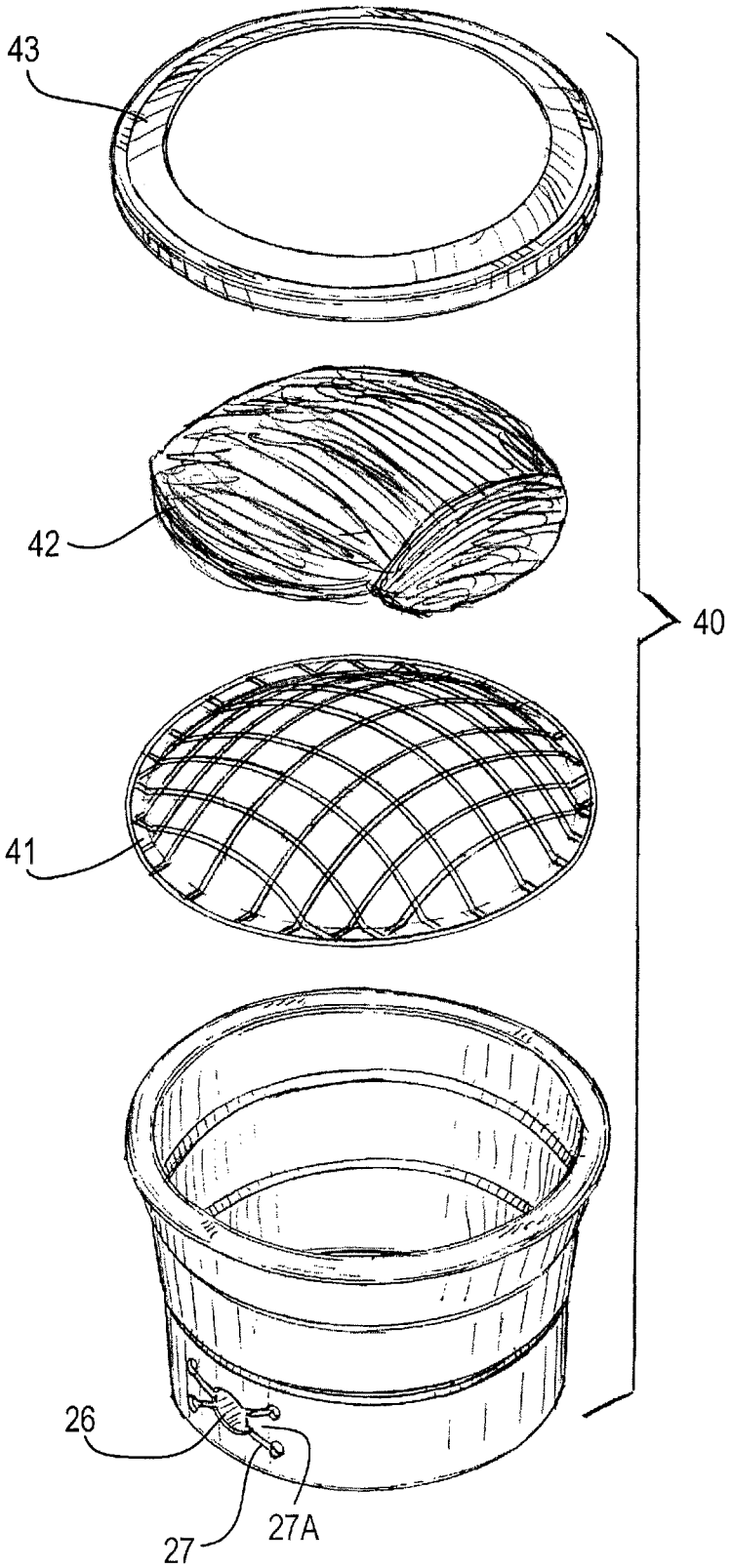
FIG. 9 is an exploded perspective view of the housing, support rack, a hair piece and top rim.
Figure 10:
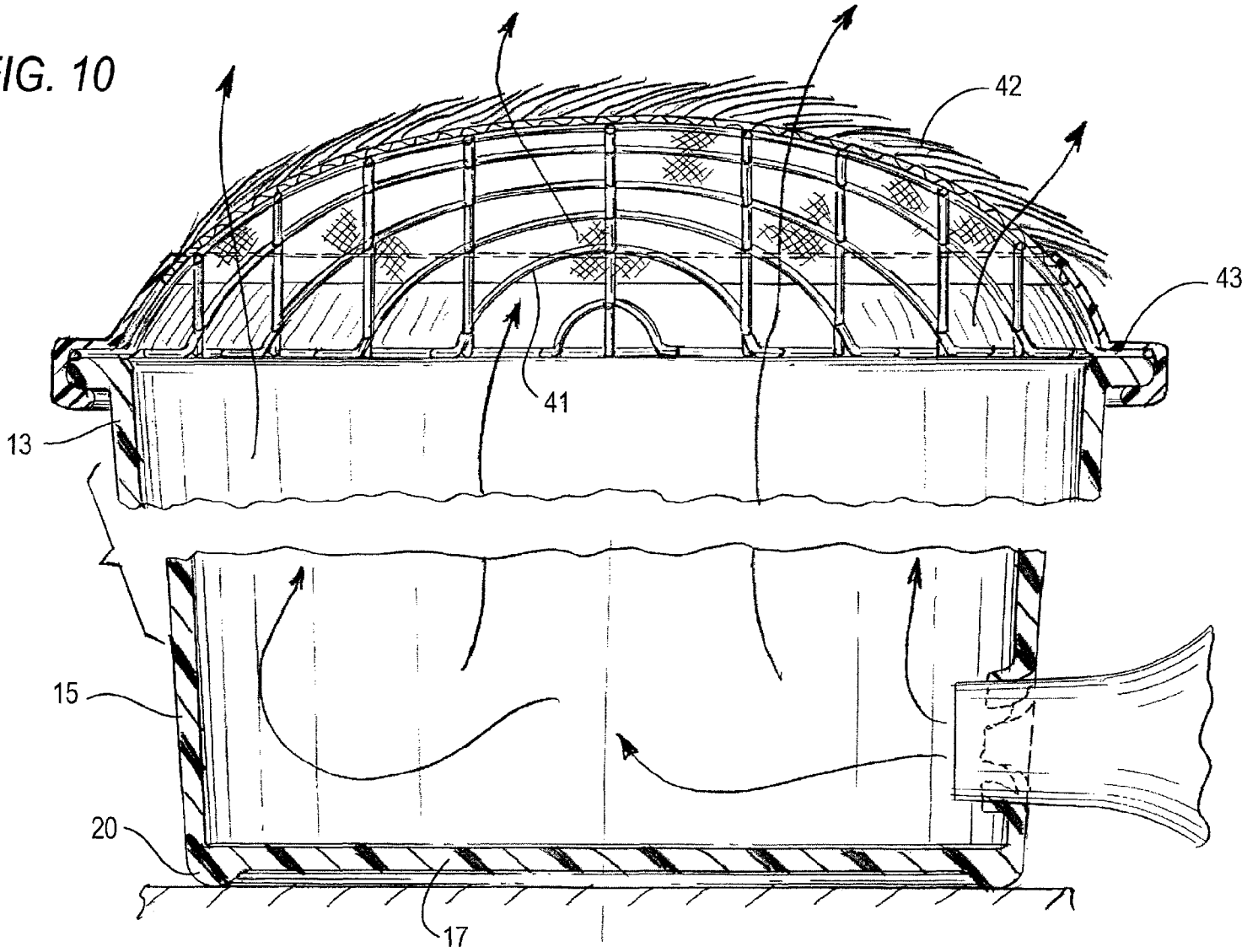
FIG. 10 is an elevation view in section showing a hair piece positioned atop the support rack at the top of the housing.

A fifth embodiment 40 of this apparatus as seen in FIGS. 9 and 10, is a variation of the second embodiment. This embodiment 40 has no garment support rack 22, but instead has first and a dome-shape support rack 41 to accommodate and support a generally convex hairpiece 42.

The circular cylindrical housing 12 in all three embodiments is formed of heat resistant nonflammable polymer rubber which is flexible but sufficiently strong and resilient to maintain a circular shaped to be self standing in its operational mode as seen in FIGS. 1-3. The lid or top ring in the three embodiments is also made of nonflammable polymer rubber. The skirt extending down from these rims may vary from straight down with a friction fit on the top edge of the housing as seen in FIGS. 1, 1A, 2 and 3, or an elastic fit from radially inward ribs as seen in FIGS. 7 and 10.

B. Operation of the Portable Dryer

In using the first portable dryer embodiment of FIGS. 1-3, one or more small garments are placed upon support rack 22, and an electric hair dryer/blower 24 is turned on to blow heated air indicated by arrows 28 into area 36 below the rack. Rack 41 is secured to the top of housing 12 by rim 43. See FIG. 7. This airflows through the aperture rack 22 into and through garments C and exhausts as indicated by arrows 43.

The basic housing 12 of the three embodiments is the same. Each housing has a hot air inlet aperture 26 which is variable in size as permitted by cuts or slits 27 terminating in generally round holes 27H which allow tabs 27A and/or tabs 27B to bend inward to accommodate a nozzle 25 of the portable hairdryer/blower, where the size of the nozzle will depend on the particular portable hairdryer/blower being used.

As described above, housing 12 is collapsible from a telescopically extended state shown in FIGS. 1-3 to telescopically collapsed state shown in FIGS. 1A and 8C. Thus, a principal object of this invention is to provide a portable garment dryer which can be collapsed into a relatively small condition for storage and/or travel, and can be extended to full height operational mode for drying garments. The apparatus shown is collapsible to essentially one third of its extended height.

As seen in FIG. 8A in order to convert the housing to its collapsed state, the user can press radially inward at the area indicated by arrow 60, and/or press downward on top segment 13 is indicated by arrow 62. Thereafter, as seen in FIG. 8B further downward pressure indicated by arrow 64 will cause further bending of middle segment 14 and lower segment 15. Alternatively, collapsing could be initiated by downward pressure on the top segment 13 per arrow 62. Because of the structure of the circumferential joints 18, 19 between top, middle and lower segments respectively, the structure of the housing as a whole has a bi-stable characteristic, wherein the housing has a tendency to stay either in its telescopically extended state as seen in FIGS. 1-3, or to snap to its fully collapsed state as seen in FIGS. 1A and 8C. In both states the housing is inherently stable with its tendency to maintain its circular shape, because the flexible resilient sidewalls have sufficient structural strength to seek to maintain their circular state. Thus, this bi-stable factor causes the housing to snap to open or closed state. For purposes of storage or travel the housing the housing would be manipulated to its fully collapsed state shown in FIG. 1A. This strength of the upper, middle and lower segments provides stability to the cylindrical housing in its open telescopically extended state for supporting the garments being dried.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the claims.

The invention claimed is:

1. A portable garment dryer, operable with a portable electric hair dryer which includes an outlet nozzle that can produce a heated airflow, comprising:

a. a housing formed by sidewalls, an open top end and a closed bottom end, said housing being telescopically collapsible in a top to bottom direction from an extended state to a contracted state, said housing side wall having an aperture extending transversely therethrough and into which the outlet nozzle of a portable electric hair dryer is insertable for directing a heated airflow into and through said housing and out said top end thereof, and b. a perforated garment support mountable in said housing, said garment support adapted to support at least one garment in said heated airflow when the outlet nozzle of a portable hair dryer is inserted into said aperture in said housing wall, whereby said garment can be dried by the heated airflow from the portable hair dryer.

2. The portable garment dryer according to claim 1 further comprising a perforated lid removably mountable to said housing above said garment support to generally cover said open end of said housing while allowing said airflow to exit said housing.

3. The portable garment dryer according to claim 1 where said housing is generally cylindrical and comprises:

(a) at least two cylindrical wall segments which in said extended state of said housing are axially aligned and in said contracted state of said housing are concentrically nestled at least one partially within the other, and (b) a flexible collar between each two adjacent wall segments, said collar having an open state when said wall segments are in their extended state, and said collar being foldable to a close state when said wall segments are axially collapsed to their contracted state.

4. The portable garment dryer according to claim 2 wherein each of said collars has a bi-stable condition between open and closed states, whereby said collar tends to stay in one or the other of said states and will snap from one of said open and closed states to the other when one of said wall segments is urged from its extended state toward its contracted state or from its contracted state toward its extended state.

5. The portable garment dryer according to claim 2 where said housing comprises a set of three of said cylindrical segments, designated upper, middle and lower, and with the bottom end of said upper segment connected by a first collar to the top end of the middle segment, and the bottom end of the middle segment connected by a second collar to the top end of the lower segment.

6. The portable garment dryer according to claim 4 where said housing comprises a set of three of said cylindrical segments, designated upper, middle and lower, and with the bottom end of said upper segment connected by a first collar to the top end of the middle segment, and the bottom end of the middle segment connected by a second collar to the top end of the lower segment.

7. The portable garment dryer according to claim 1 where said garment support is a mesh structure of intersecting ribs, the support's peripheral outer edges are engageable to the top part of said top end of said housing.

8. The portable garment dryer operable with portable hair dryers having outlet nozzles of different sizes, according to claim 1, where said cylindrical wall opening is variable in size to accommodate said different size outlet nozzles of different electric hair dryers.

9. The portable garment dryer according to claim 1 where said aperture through said cylindrical wall comprises two intersecting slits forming four leaves that are deflectable transversely of the wall's circumferential surface when a portable hair dryer outlet nozzle is inserted through said opening.

10. The portable garment dryer according to claim 8 where said aperture is a generally circular hole in said wall and a plurality of slits extending transversely through said wall, each slit extending outwardly from the peripheral edge of said hole.

11. The portable garment dryer according to claim 1 where said housing comprises sheet material that is flexible and resilient.

12. The portable garment dryer according to claim 5 where said middle segment has outer diameter generally smaller than said upper segment so that it can nestle into said upper segment in said telescopically collapsed state, and where said lower segment has outer diameter generally smaller than said middle segment, so that it can nestle into said middle segment in said telescopically collapsed state.

13. A portable garment dryer operable with a portable electric hair dryer which includes a heated airflow outlet nozzle, comprising a. a housing formed by a cylindrical wall about a central longitudinal axis with an open top end and a closed bottom end, said housing being telescopically collapsible axially between an extended height and a reduced height, b. a perforated garment support mountable to said housing, and c. a perforated lid mountable to said housing as said top end thereof, said lid dimensioned to overlie said garment support and generally cover said opening of said housing, said cylindrical wall having upper and lower parts and having in said lower part an aperture extending transversely therethrough, said portable garment dryer operable to dry garment supported on said garment support when the outlet nozzle of a portable hair dryer is inserted into said aperture and directs a flow of heated air into said housing, through said perforated garment support, through a garment supported thereon, and discharged through perforations in said lid.

14. The portable garment dryer according to claim 13 where said aperture has a variable diameter adapted to receive outlet nozzles of varying diameters of different portable hair dryers.

15. A portable garment dryer comprising:

a. a housing formed by cylindrical sidewalls defining an open top end and a closed bottom end, b. a garment support mountable in said housing generally near said top end thereof, said garment support adapted to releasably engage and support at least one garment in said airflow, and c. an electric heater blower mounted in said bottom segment for producing a heated airflow upward through said housing, said housing being telescopically collapsible from an extended height in its operable state to a reduced tight in its close state, said cylindrical wall having an aperture extending transversely through said wall and into which the outlet nozzle of a portable electric hair dryer is insertable for directing a heated airflow through said housing, into a garment at said top end of said housing, and exhausted out of said top end.

16. A portable garment dryer, operable with a portable electric hair dryer which includes an outlet nozzle that can produce a heated airflow, comprising:

a. a housing formed by sidewalls, an open top end and a closed bottom end, said housing being collapsible in a top to bottom direction from an extended state to a contracted state, said housing side wall having an aperture extending transversely therethrough and into which the outlet nozzle of said portable electric hair dryer is insertable for directing a heated airflow into and through said housing and out said top end thereof, and b. a garment support in the region of the top of said housing that can engage and releasably hold at least a portion of a garment extended across said open top end of said housing, whereby said engaged garment can be dried by the heated airflow through said garment when the outlet nozzle of a portable hair dryer is inserted into said aperture in said housing wall and said heated air flows through said housing and through said garment.

17. The portable garment dryer according to claim 16 where said garment support is at the top of said housing.

18. the portable garment dryer according to claim 16 where said garment support his at the outer periphery of said housing.

19. The portable garment dryer according to claim 16 where said garment support comprises a lid formed as a disc with a central aperture and having resilient body portions to releasably engage said garment.

20. The portable garment dryer according to claim 19 where said garment support's body portions are situated around the outer periphery of said lid.

* * * * *